US011866289B1

(12) United States Patent
Romano

(10) Patent No.: US 11,866,289 B1
(45) Date of Patent: Jan. 9, 2024

(54) HAND-HELD HOSE GUIDE

(71) Applicant: Nicholas Romano, Oceanport, NJ (US)

(72) Inventor: Nicholas Romano, Oceanport, NJ (US)

( * ) Notice: Subject to any disclaimer, the term of this patent is extended or adjusted under 35 U.S.C. 154(b) by 162 days.

(21) Appl. No.: 17/518,085

(22) Filed: Nov. 3, 2021

(51) Int. Cl.
*B65H 57/14* (2006.01)

(52) U.S. Cl.
CPC ..... *B65H 57/14* (2013.01); *B65H 2701/33* (2013.01)

(58) Field of Classification Search
CPC ..... B65H 57/00; B65H 57/14; B65H 75/406; B65H 75/4402; B65H 2404/41; B65H 2404/412; B65H 2701/33; B65H 2701/391; B65H 75/366; E03F 7/106; A62C 33/02
See application file for complete search history.

(56) References Cited

U.S. PATENT DOCUMENTS

| | | | | | |
|---|---|---|---|---|---|
| 522,524 | A * | 7/1894 | Hook | B63B 21/08 | 248/55 |
| 2,651,312 | A | 9/1953 | McBeth | | |
| 2,816,734 | A * | 12/1957 | Crofoot | B65H 75/4402 | 242/615.3 |
| 4,540,017 | A * | 9/1985 | Prange | B65H 75/441 | 137/355.12 |
| 5,364,043 | A * | 11/1994 | Linderoth | B65H 54/2857 | 242/478.2 |
| 5,853,142 | A | 12/1998 | Anderson | | |
| 6,763,547 | B1 | 7/2004 | Brewer et al. | | |
| 6,814,327 | B1 * | 11/2004 | Myer, II | A47L 11/4094 | 242/615.3 |
| 7,438,250 | B2 | 10/2008 | Anderson et al. | | |
| 8,122,913 | B2 | 2/2012 | Stark | | |
| 9,243,724 | B1 | 1/2016 | Lake et al. | | |
| 9,272,874 | B1 * | 3/2016 | Davis, Jr. | B65H 51/10 | |
| 9,656,307 | B1 * | 5/2017 | Blevins | B65H 51/14 | |
| 10,150,144 | B2 * | 12/2018 | Suiter | E03F 7/106 | |
| 2002/0185017 | A1 * | 12/2002 | Peek | A62C 33/02 | 100/155 R |
| 2005/0035142 | A1 | 12/2005 | Davis | | |
| 2006/0162782 | A1 | 7/2006 | McNeese | | |
| 2019/0359446 | A1 * | 11/2019 | Bender | B65H 57/14 | |
| 2021/0071803 | A1 * | 3/2021 | Warren | B65H 57/00 | |

OTHER PUBLICATIONS

Hannula; US Statutory Invention Registration 1996004-04 Hannula; Published Mar. 5, 1996; Five Pages, Reg No. H1520.

* cited by examiner

*Primary Examiner* — Sang K Kim
*Assistant Examiner* — Nathaniel L Adams
(74) *Attorney, Agent, or Firm* — Goldstein Law Offices, P.C.

(57) ABSTRACT

A handheld hose guide which accommodates hoses of varying diameters and protects a user from debris on the hose when reeling the hose onto a hose reel, including a housing having a pair of housing parts for enclosing the hose, wherein the pair of housing parts when in a closed position form an interior, cylindrically-shaped longitudinal channel, which longitudinal channel generally conforms to a shape of the hose, a hinge attached to each of the pair of housing parts for providing angular movement of each housing relative to the other housing, a locking device attached to the pair of housing parts for securing the hose within the housing during operation of the hose guide, and rollers which are attached to springs that are biased inwardly, in order to accommodate hoses of various diameters and to provide constant compression on the hose during operation of the hose guide.

6 Claims, 7 Drawing Sheets

HAND-HELD HOSE GUIDE

TECHNICAL FIELD

The present disclosure relates generally to a hose guide for assisting a user in guiding a hose onto a hose reel. More particularly, the present disclosure relates to a handheld hose guide which accommodates hoses of varying diameters.

BACKGROUND

Many hose reel systems require the user to manually manipulate the hose during the reeling process in order to feed the hose onto the reel in an orderly and compact fashion. While a hose is being used however, it is likely to pick up chemicals, dirt, glass, animal waste, and other debris and contaminants that is on the ground or the work area where the hose is being used. Such contaminants will easily transfer to a user's hands during the reeling process. Additionally, many hoses are constructed from mesh wiring, and this wiring can become exposed by wearing through the outer layers of the hose. Some of these items can be harmful or even dangerous to the user while the user is hand feeding the reel. It would be beneficial to provide a device that allows the user to guide the hose on the reel in a controlled fashion, without requiring the user to directly touch the hose.

Prior art systems have provided stakes attached to the ground and other methods for guiding the hose, but fail to provide a hand-held device that is able to accommodate hoses of varying dimensions. These devices typically are used to keep the hose out of flower beds and other sensitive areas, but are not effective for isolating the hose and its debris from the user during the operation of the hose guide. Clearly, there is a need for a hand-held hose guide which assists the user in reeling the hose onto the hose reel, and subsequently unreeling the hose, while at the same time protecting the user from harmful debris on the hose.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a handheld hose guide which accommodates hoses of varying diameters and protects a user from debris on the hose when reeling the hose onto a hose reel. Accordingly, the present disclosure describes a housing for enclosing the hose, including an upper housing part and lower housing part that are hingedly attached together, wherein when closed said housing parts have a pair of end wall openings and form a longitudinal channel which extends fully between the end walls of the device, which longitudinal channel generally conforms to the shape of the hose. The hinge allows angular movement providing angular movement of each housing part relative to the other housing part to allow the housing to open to allow for insertion of the hose into the channel, and a locking device attached to the housing parts for maintaining the housing in the closed position and thereby securing the hose within the channel during operation of the hose guide. The device includes rollers which engage the hose within the channel and are attached to an internal mechanism that is biased inwardly, in order to accommodate hoses of various diameters and to provide constant compression on or at least continual engagement with the hose during operation of the hose guide.

It is another aspect of an example embodiment to provide a method for reeling or unreeling a hose onto a hose reel. Accordingly, the present disclosure provides a housing having a pair of housing parts. The housing parts form a longitudinal channel when closed, which longitudinal channel generally conforms to the shape of the hose. A hinge attached to each of the housing parts provides rotational movement of each housing part relative to the other housing part, rotating the housing parts around the hinge until the housing parts come into a closed position around the hose. A locking mechanism maintains the housing in the closed position, so that the user can hold the hose guide while reeling or unreeling the hose onto the hose reel and avoid directly touching the hose.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
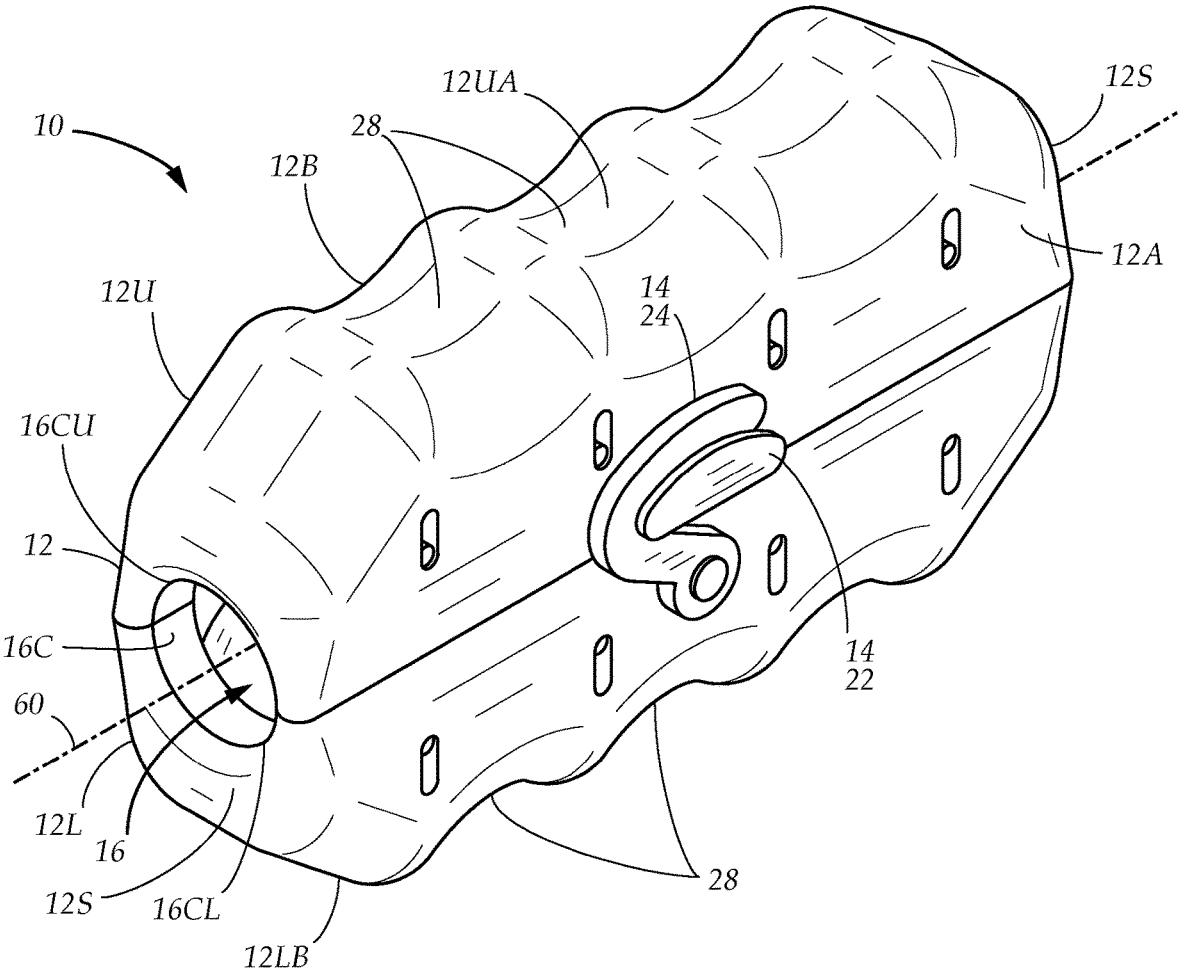
FIG. 1 is a diagrammatic perspective view of a hose guide in accordance with an embodiment in the present disclosure.

FIGS. 1-7B illustrate a hose guide 10 comprising a housing 12, having pair of housing parts, namely an upper housing 12U and a lower housing 12L, as shown in FIG. 1. FIG. 1 shows the hose guide 10 in a closed position, with the upper housing 12U and the lower housing 12L, resting in contact with each other. The housing 12 having a front wall 12A, rear wall 12B, and a pair of end walls 12S. The upper housing having a top 12UA and the lower housing having a bottom 12LB. Better seen in FIG. 2, the upper housing 12U having a lower edge 12UE and the lower housing having an upper edge 12LE. The upper edge of the lower housing 12LE and the lower edge of the upper housing 12UE are connected by a hinge 34 at the rear wall 12B.

Figure 2:
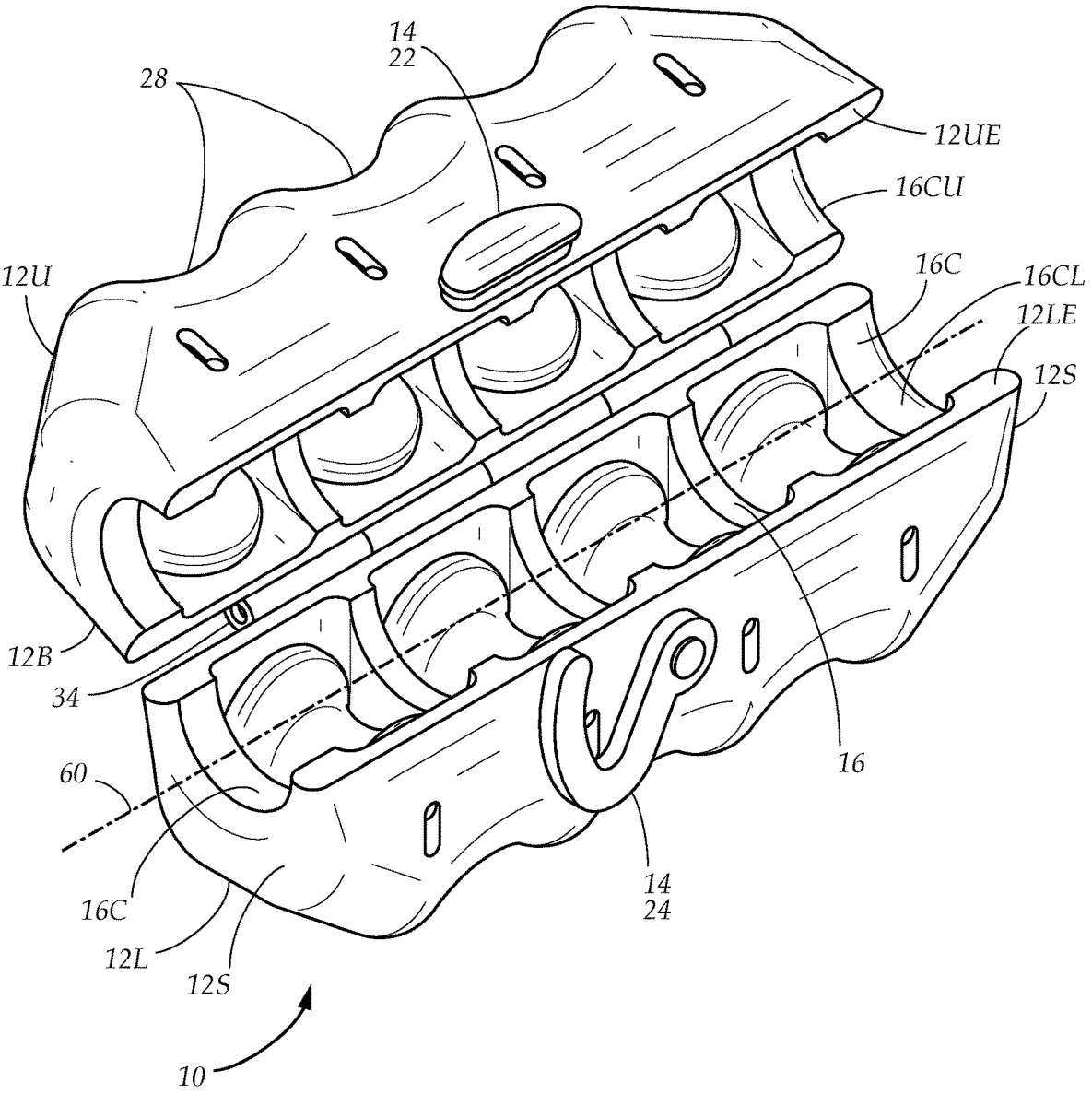
FIG. 2 is a diagrammatic perspective view of a hose guide depicting the housing parts in an open position, in accordance with an embodiment in the present disclosure.

Referring to FIGS. 1 and 2, the end walls 12S of the housing 12 each have an end opening 16C. A longitudinal channel 16 extends fully between the end openings 16C of the end walls 12S. The end openings 16C may be generally circular in shape. When the housing 12 is in the closed position, the longitudinal channel 16 forms a generally cylindrical shape between the end openings 16C, one end of which is seen at the end opening 16C on the left side of FIG. 1. Each end opening 16C is formed by an upper end opening 16CU and a lower end opening 16CL, which are each semicircular and together create the end opening 16C when the housing parts 12U, 12L are in the closed position. The longitudinal channel 16 provides a pathway for a hose to extend through the housing 12 and move fully therethrough. The pathway for a hose 30 (see FIG. 3, 4, 7A, 7B) follows a longitudinal axis 60 through the center of the longitudinal channel 16. A locking device 14 is shown attached to the front wall 12A of the hose guide 10. Indents 28 are provided in both the upper housing 12U and the lower housing 12L, although in other embodiments, the indents might be present on only one of the housing parts 12U, 12L to conform with the user's fingers when holding the housing 12, with a smooth surface on the other housing part 12U, 12L to conform with the palm of the user's hand.

FIG. 2 shows the hose guide 10 in an open position, revealing its interior, with the housing parts 12U, 12L pivoted away from each other. The locking device 14 is shown as a latch 24 with a corresponding tab 22, wherein in this case the lower housing part 12L has the latch 24 and the upper housing part 12U has the corresponding tab 22 — although such may be reversed. Such a mechanism may require manual unhooking of the latch 24 to free it from the corresponding tab 22 and unlock the housing parts 12U, 12L so that they may pivot open. In another example embodiment, a push-button release mechanism as known in the art, may be employed to allow quick and easy release of the locking device 14. Such push-button release mechanism (not shown in the figures) may contain a latch 24 and tab 22 as well, but with a spring-loaded actuation system that provides for quick release of the locking device 14 by pushing a button. The hinge 34, as described above, which allows for angular movement of the housing parts 12 U, 12L relative to each other about a pin of the hinge 34.

Figure 7A:
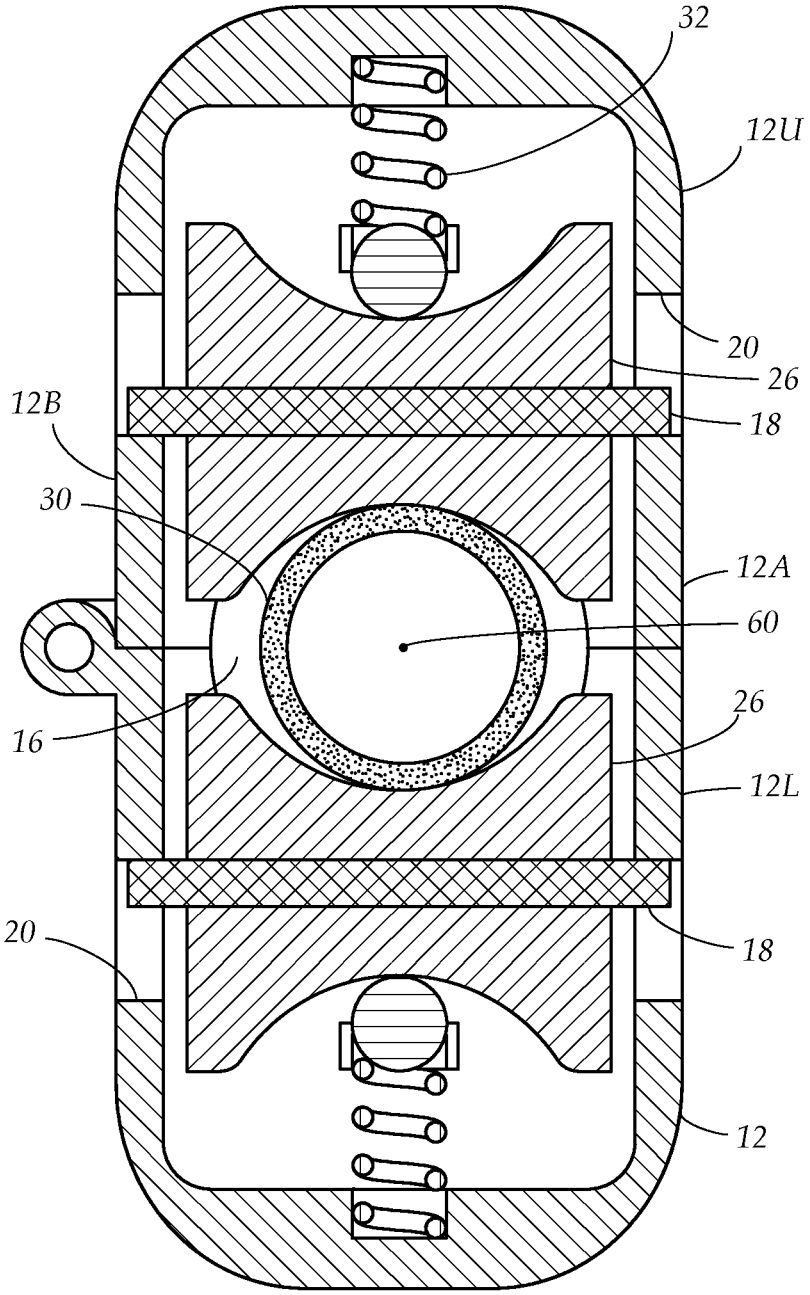
FIG. 7A is a diagrammatic cross-sectional view of a hose guide depicting the housing parts in a closed position with a hose inside, in accordance with an embodiment in the present disclosure.
Figure 7B:
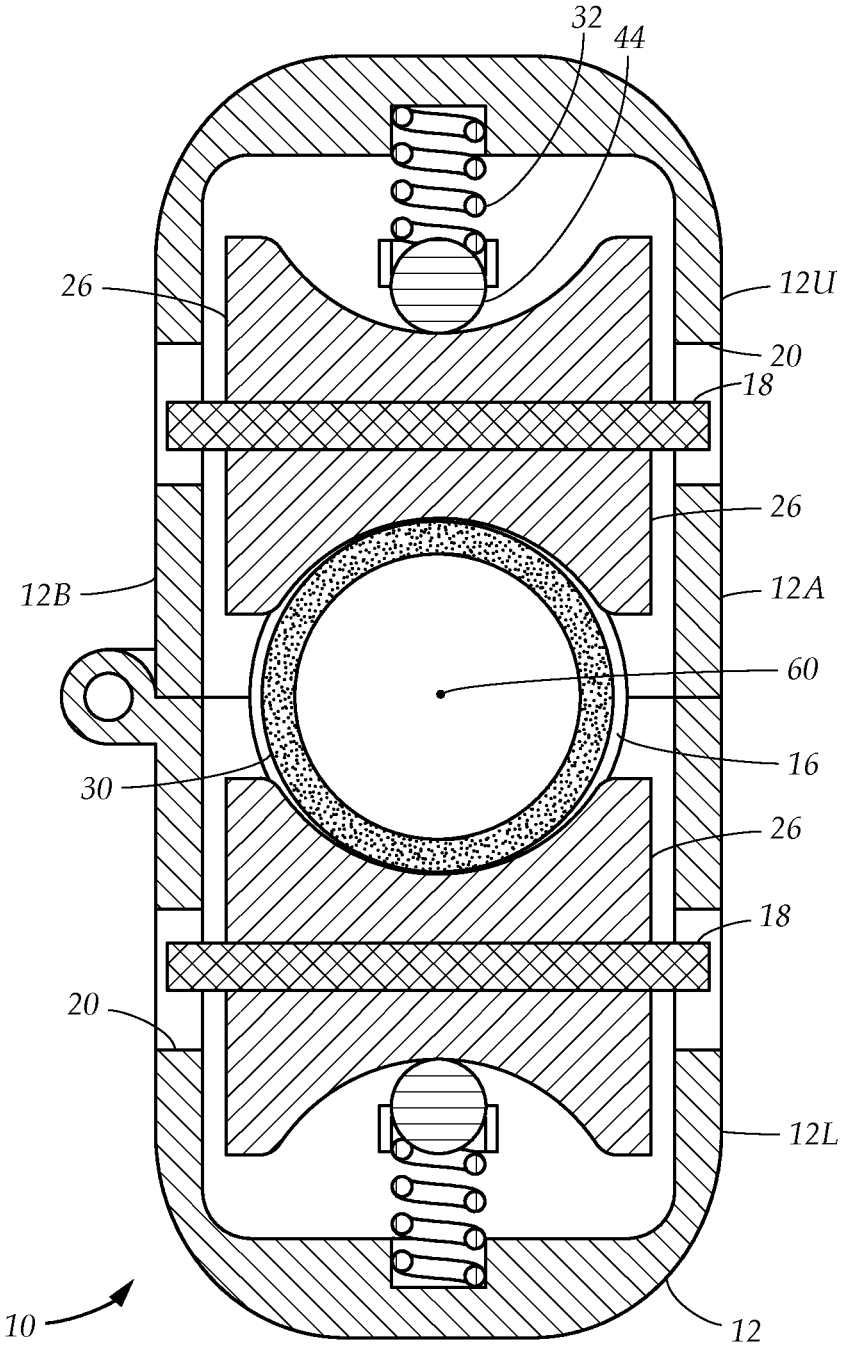
FIG. 7B is a diagrammatic cross-sectional view of a hose guide depicting the housing parts in a closed position, similar to FIG. 7A except with a larger hose inside, such that the spring is compressed to allow the roller to expand clearance within the longitudinal channel for said larger hose, in accordance with an embodiment in the present disclosure.

Best seen in FIG. 7A and 7B the hose guide 10 has a least one roller 26 associated with each of the upper and lower housing parts 12U, 12L of the housing 12. A spindle 18 is provided in association with each roller and extends axially through that roller 26. The housing 12 has spindle slots 20 in the front wall 12A and rear wall 12B. The spindles 18 extend between the spindle slots 20 for supporting the rollers 26 within the interior of the housing 12. The rollers 26 extend transverse and adjacent to the longitudinal channel 16 for engaging the hose 30 when extending. The spindle slots 20 allow the spindles 18 to move upwardly and downwardly as the rollers 26 move toward and away from the longitudinal axis 60 of the longitudinal channel 16 to accommodate hoses 30 of varying diameters.

The rollers 26 allow for smooth movement of the hose 30 through the hose guide 10. A suspension system of various configurations may be provided to allow hoses 30 of various diameters to be accommodated, while also helping to maintain the rollers 26 in engagement with the hose 30 extending through the longitudinal channel 16. The suspension system may include a spring 32 associated with each spindle 18, as described more fully below.

Figure 3:
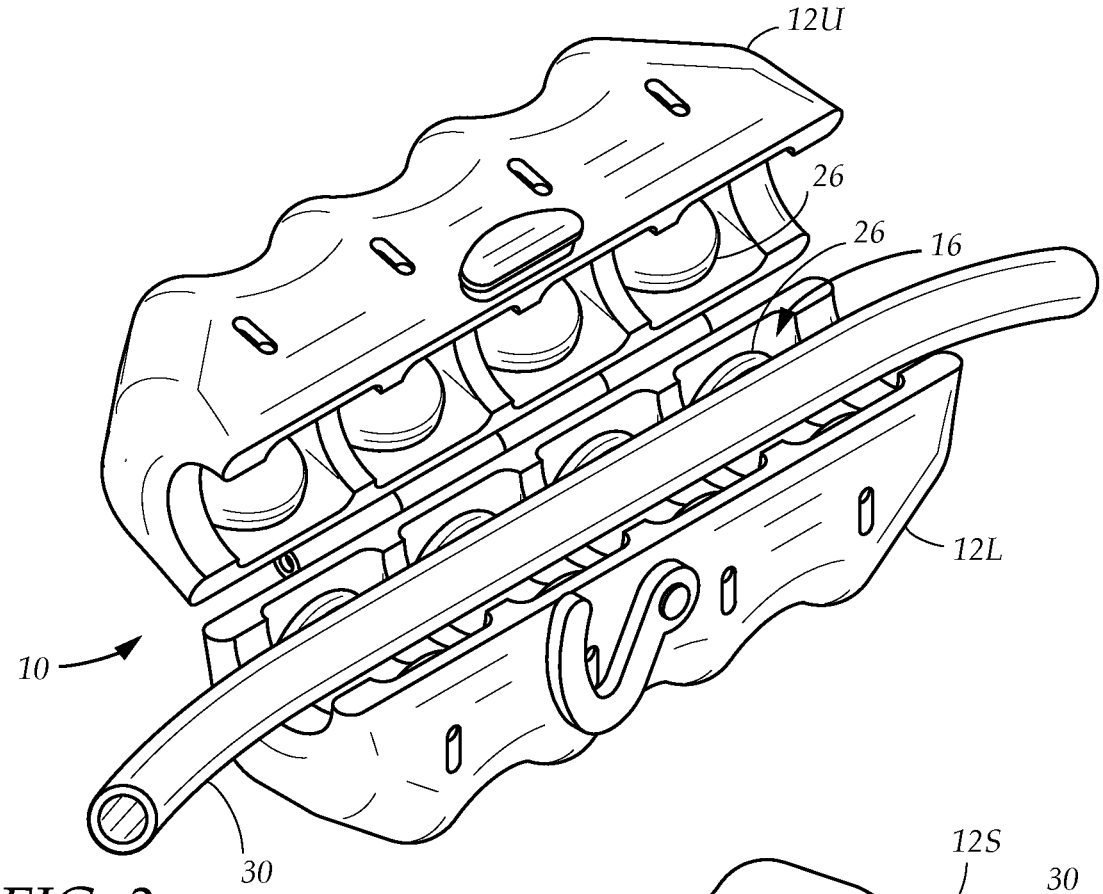
FIG. 3 is a diagrammatic perspective view of a hose guide depicting the housing parts in an open position with a hose extending through the longitudinal channel, in accordance with an embodiment in the present disclosure.

FIG. 3 shows the hose guide 10 in an open position, with the hose 30 resting on the rollers 26 of the lower housing 12L. The hose in this position extends through the longitudinal channel 16, of the lower housing 12L. In the open position, the user can move the hose 30 laterally onto the longitudinal channel 16 at any point along a length of the hose 30, without having to start with an end of the hose 30. Note, to illustrate this point, the hose 30 is shown to be of indefinite length, with the ends thereof not shown. The rollers 26 on the upper housing 12U will also come into contact with the hose 30 once the user closes the upper housing 12U onto the lower housing 12L.

Figure 4:
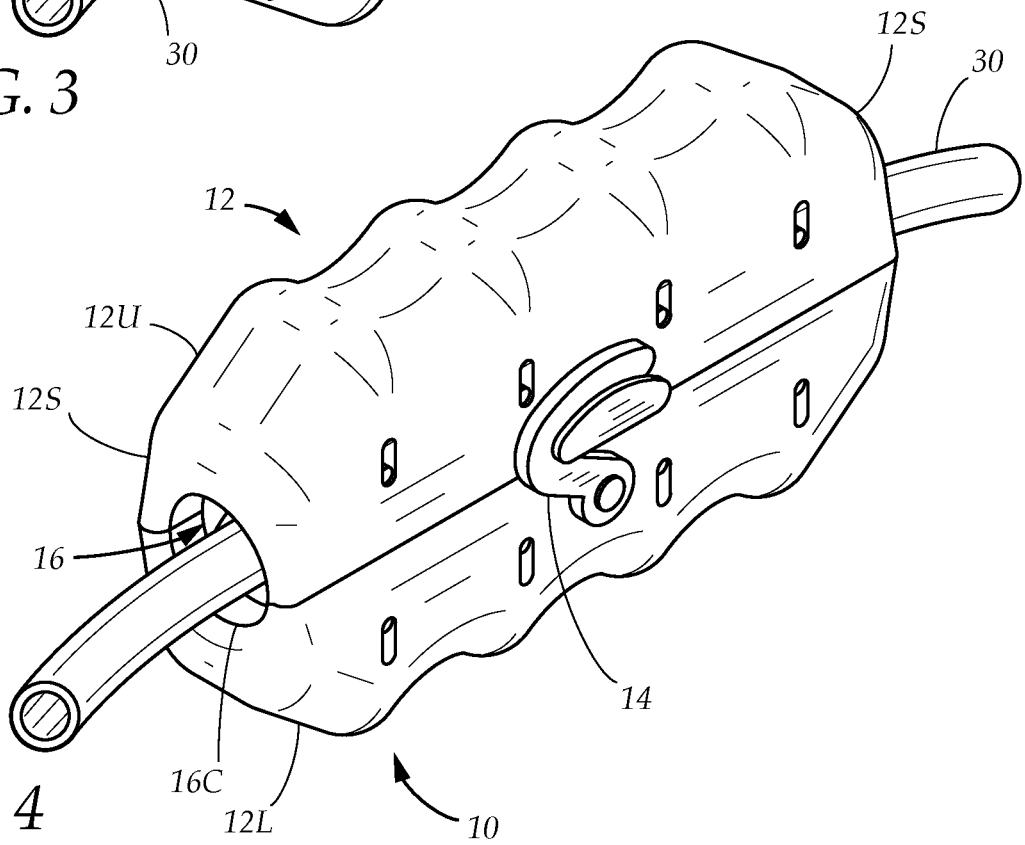
FIG. 4 is a diagrammatic perspective view of a hose guide depicting the housing parts in a closed position with a hose extending through the longitudinal channel inside the closed housing, in accordance with an embodiment in the present disclosure.

FIG. 4 shows the hose guide 10 in a closed position, with the hose 30 extending between the upper housing 12U and the lower housing 12L through the longitudinal channel 16 between the end walls 12S. The hose 30 can be seen extending past the end opening 16C. The locking device 14 is also shown engaged to maintain the housing 12 in the closed position. In a closed position, the longitudinal channel 16 forms a generally cylindrical shape, and forms a pathway for the hose 30 to travel fully through the housing 12 during the operation of the device. Through movement of the roller 26 (see FIG. 3), the pathway through the longitudinal channel generally conforms to the shape of a hose 30, and may be slightly larger than the hose 30. Rollers 26 on the upper housing 12U and lower housing 12L are biased inwardly by the suspension system in order to accommodate hoses 30 of various diameters and to provide consistent engagement/compression on the hose 30 during operation of the hose guide 10, while the rollers 26 (see FIG. 7A) spin freely to allow the hose 30 to pass through the hose guide 10 during operation. The internal mechanism can be the spring 32 seen in FIG. 7A or other devices known in the art.

Figure 5:
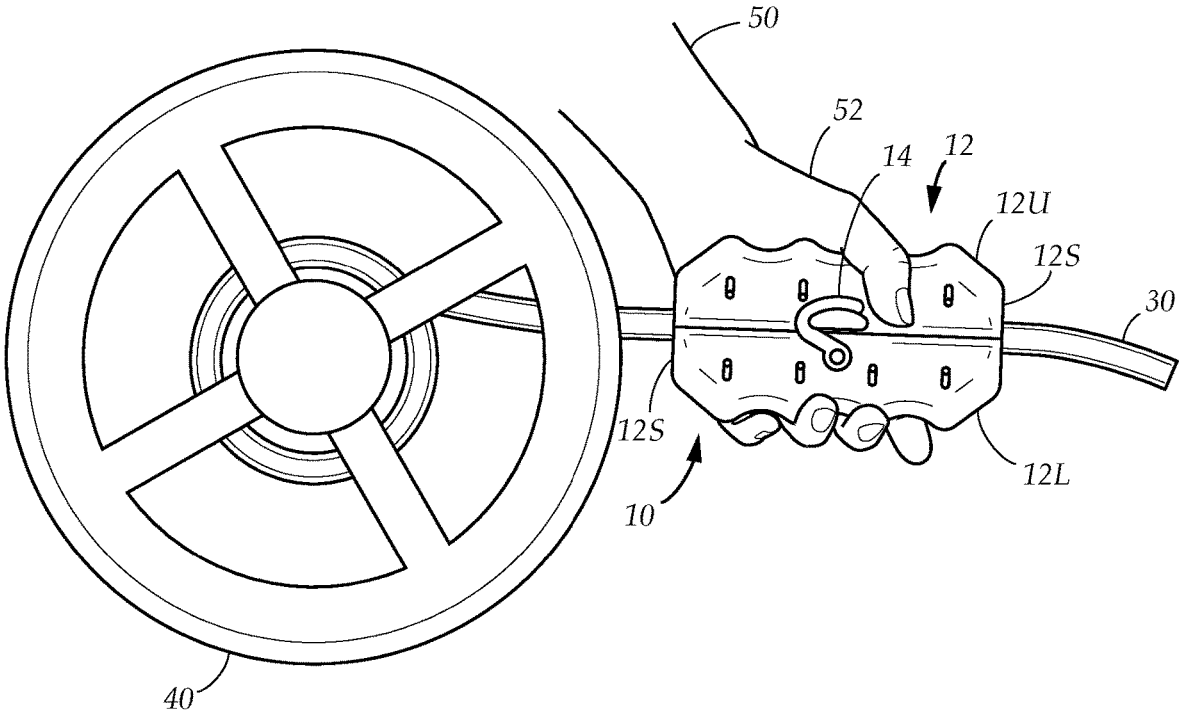
FIG. 5 is a diagrammatic side view of a hose guide in operation by a user, in accordance with an embodiment in the present disclosure.

FIG. 5 shows an example of the operation of the hose guide 10 by a user 50, having a hand 52. The hose 30 is extending through the hose guide 10, through the longitudinal channel 16 (not shown) extending between the two end walls 12S of the housing 12. The user 50 is holding the hose guide 10 in the hand 52 of the user 50 to guide the hose 30 as it is reeled onto a hose reel 40. The hose guide 10 is in a closed position, and the locking device 14 is shown in the engaged position to maintain the housing 12 in the closed position and thereby keep a secure hold on the hose 30.

Note that the upper housing 12U and lower housing 12L may be configured in a variety of shapes to fit the user's hand, while still adhering to the general principles of the present disclosure. In one embodiment, the hose guide 10 may be 6 inches in length and 2.5 inches wide, and such dimensions may be varied according to the size of the hose and for allowing the device to be comfortably hand-held. Additionally, the hose guide 10 may be formed from a variety of different materials. In one embodiment, the outer surface of the house guide 10 may be partially or entirely made from rubber or other non-slip material.

Figure 6:
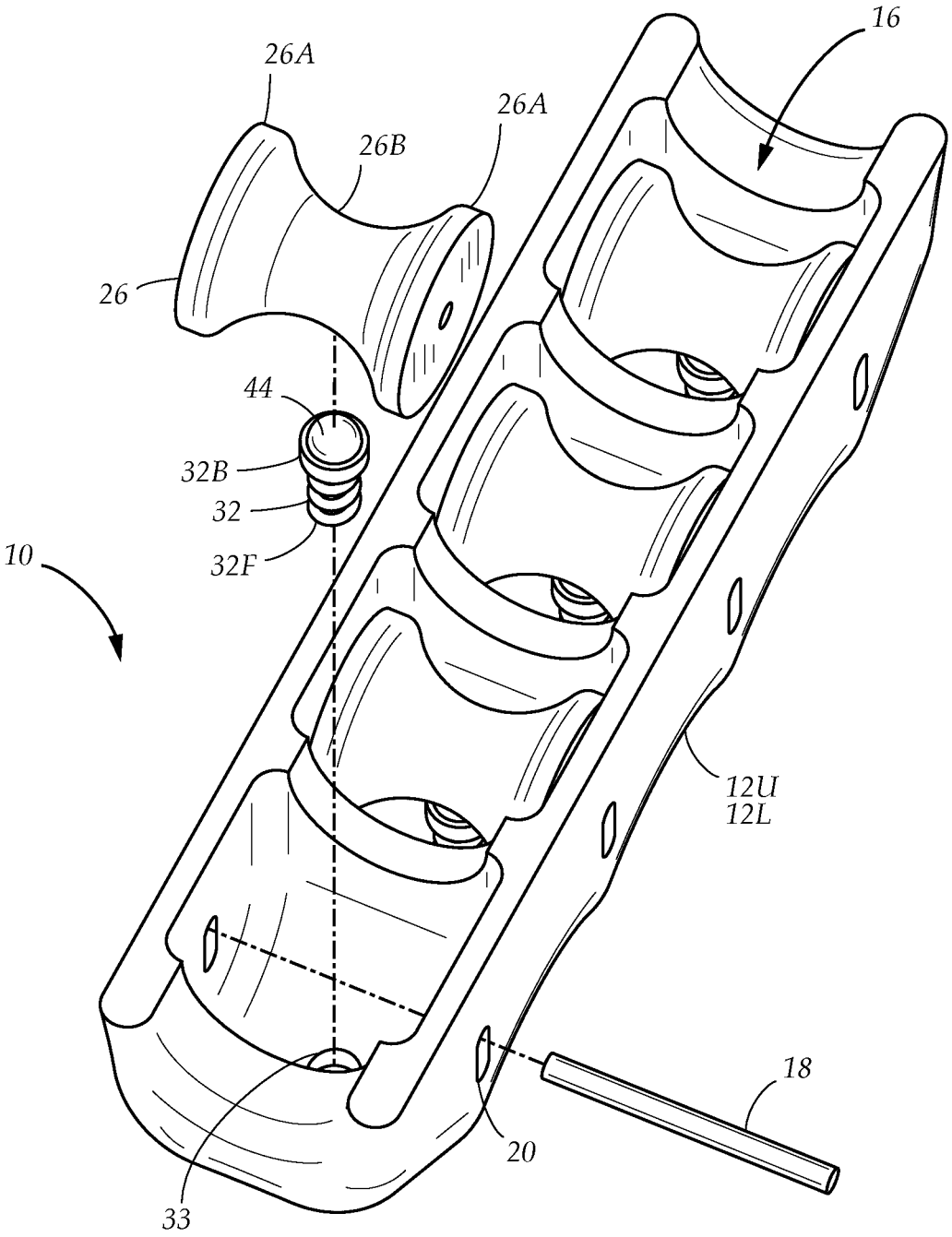
FIG. 6 is a diagrammatic exploded view of a hose guide depicting one of the rollers, a spindle upon which the roller rotates, and a spring for biasing the roller toward the longitudinal channel, in accordance with an embodiment in the present disclosure.

FIG. 6 is an exploded view, showing one of the housing parts 12U, 12L and detailing some of the internal components of the hose guide 10 including multiple rollers 26. As noted previously, each spindle 18 supports one of the rollers 26. The suspension system may include the spring 32 associated with each spindle 18. The spring 32 has a fixed end 32F and a bearing end 32B. The bearing end 32B has a ball bearing 44 for pressing against the roller 26 with reduced friction. The top housing 12U and lower housing 12L may have a spring indent 33 associated with each spring 32, for anchoring the free end 32F of the spring 32 and allowing it to extend perpendicularly to and bias one of the rollers 26 toward the longitudinal channel 16, in order to accommodate hoses of various diameters and to provide constant compression on the hose during operation of the hose guide 10. The spindle slots 20 allow the spindles 18 to move upwardly and downwardly as the rollers adjust to hoses of varying diameter. Each roller may include a pair of end flanges 26A and a concave valley 26B between the end flanges 26A. The concave valley is sized and shaped to accommodate approximately half of the circumference of the hose that the hose guide 10 is to be used with.

FIGS. 7A and 7B show the hose guide 10 in a closed position, with a hose 30 resting between the upper housing 12U and the lower housing 12L. Note that in FIG. 7A and 7B the hoses are of different diameters. Since the rollers 26 on the upper housing 12U and lower housing 12L are spring 32 biased inwardly toward the longitudinal channel, despite the different diameters, each roller 26 remains engaged with the hose 30 and provide constant compression on the hose 30 during operation of the hose guide 10. The rollers 26 spin freely to allow the hose 30 to pass through the hose guide 10. Each spindle 18 passes axially through one of the rollers 26. The ball bearing 44 is pressed by the spring 32 against the roller 26 with reduced friction, to allow for smooth rotation of the rollers 26. Since hose 30 shown in FIG. 7B has a larger diameter than the hose 30 shown in FIG. 7A, the spring 32 is compressed, and the longitudinal opening 16 between the rollers 26 is expanded further to accommodate the larger diameter hose 30. The longitudinal axis 60 of the longitudinal channel 16 is shown in the figures as a point in the center of the hose 30, which shows the pathway through which the hose 30 travels with the hose guide 10.

In one example embodiment, referral to FIGS. 1-7B generally, the operation of the hose guide 10 may be as follows. The user 50 grasps the hose 30 with the hose guide 10 in the open position. The user can grasp the hose 30 at any portion along the length of the hose 30, without having to grasp or locate one of the ends of the hose. The user 50 positions the hose 30 onto the rollers 26 of the lower housing 12L with the hose extending through the end openings 16C and then pivots the upper housing 12U toward the lower housing 12L to close the hose guide 10. The user may employ the locking device to maintain the hose guide 10 in the closed position. By holding the hose guide 10 in the hand 52 of the user 50, the user 50 may then guide the hose 30 onto the hose reel 40 or unreel the hose 30 from the hose reel 40. Once the hose 30 is in the desired position, the locking device 14 may be released, the upper housing 12U pivoted open from the lower housing 12L, and the hose 30 removed from the hose guide 10.

Other embodiments are certainly possible. For example, although not shown in the figures, bristles or other excoriating materials may be attached to the interior of the hose guide 10, in order to clean the hose 30 while the hose guide 10 is being used. Additionally, an attachment mechanism may be provided with the hose guide 10 so that it may be stored on the hose reel 40. In one embodiment, this may comprise a hanger attached to the hose guide 10 or a hole in the hose guide which attaches to the hose reel 40.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a hose guide for assisting a user in guiding a hose onto a hose reel. The disclosure is illustrated by example in the drawing figures, and throughout the written description. It should be understood that numerous variations are possible, while adhering to the inventive concept. Such variations are contemplated as being a part of the present disclosure.

What is claimed is:

1. A hose guide for allowing a user to reel or unreel a hose on a hose reel without actually touching the hose, comprising:

a housing having two end walls, each end wall having an end opening, the housing having a pair of housing parts together configured to enclose and form a longitudinal channel between the end openings in the end walls, the longitudinal channel having a longitudinal axis;

a hinge connecting the housing parts and allowing relative rotation of the housing parts between an open and a closed position, when in the open position the hose guide is adapted for allowing the hose to move laterally into the longitudinal channel, when in the closed position the hose guide is adapted for securing the hose within the longitudinal channel while extending through both end openings; and at least one roller within each of the housing parts, adapted to engage the hose when extending through the longitudinal channel and facilitate longitudinal movement of the hose through the housing, each roller has a spring associated with said roller and having a free end and a bearing end, the bearing end having a ball bearing for pressing against the roller with reduced friction, wherein the housing parts have a spring indent associated with each spring, and wherein the free end of each spring is mounted in one of the spring indents, each roller is biased inwardly towards the longitudinal axis in order to accommodate hoses of various diameters and to provide consistent engagement with the hose during operation of the hose guide.

2. The hose guide as described in claim 1, wherein the pair of housing parts is an upper housing and a lower housing, and wherein the hose guide further has a locking device attached to the pair of housing parts for maintaining the housing in the closed position and securing the hose within the pair of housing parts during operation of the hose guide.

3. The hose guide as described in claim 2, wherein the locking device comprises a tab attached to one of the housing parts and a latch attached to the other housing part for engaging with the tab.

4. The hose guide as described in claim 3, wherein at least one of the housing parts has multiple indents on its outer surface so that it is adapted to conforming generally with a hand of the user.

5. The hose guide as recited in claim 4, wherein the housing has a front wall and a rear wall, wherein the hinge is located at the rear wall, and the locking device is located at the front wall.

6. The hose guide as recited in claim 5, wherein each of the end openings is formed by an upper end opening on the upper housing and a lower end opening on the lower housing.

* * * * *